United States Patent [19]

Gradmann

[11] 4,436,065

[45] Mar. 13, 1984

[54] STARTER ARRANGEMENT FOR INTERNAL COMBUSTION ENGINE

[75] Inventor: Gerhard Gradmann, Ketsch, Fed. Rep. of Germany

[73] Assignee: Deere & Company, Moline, Ill.

[21] Appl. No.: 365,852

[22] Filed: Apr. 5, 1982

[30] Foreign Application Priority Data

May 13, 1981 [DE] Fed. Rep. of Germany ..... 302128

[51] Int. Cl.[3] ..... F02N 17/00

[52] U.S. Cl. ..... 123/179 B; 123/179 A; 200/293; 200/159 B

[58] Field of Search ..... 123/179 A, 179 B, 179 BG, 123/179 K, 198 D, 630, 632; 290/38 C, DIG. 1; 200/333, 293, 159 B; 335/12, 13, 173

[56] References Cited

U.S. PATENT DOCUMENTS

| | | | |
|---|---|---|---|
| 2,828,382 | 3/1958 | Davidson | 123/179 BG |
| 2,887,588 | 5/1959 | Williams | 123/179 B |
| 2,949,105 | 8/1960 | Davis | 123/179 B |
| 2,989,644 | 6/1961 | Schultz | 123/179 B |
| 3,071,125 | 1/1963 | Leaver et al. | 123/179 B |
| 3,208,021 | 9/1965 | Elliott | 200/44 |
| 3,553,472 | 1/1971 | Arlandson | 290/38 |
| 3,808,914 | 5/1974 | Hauser | 123/179 K |

FOREIGN PATENT DOCUMENTS

| | | | |
|---|---|---|---|
| 878762 | 5/1968 | Canada | 342/13 |
| 1586004 | 3/1982 | United Kingdom . | |

*Primary Examiner*—Ira S. Lazarus
*Assistant Examiner*—R. S. Bailey

[57] ABSTRACT

A starter relay includes a battery terminal, a starter motor terminal connected to the starter motor and a coil for making the relay contacts, with a coil terminal and an energizing circuit which includes a safety switch, as well as an ignition switch and starter switch. Two manually-operable bridging contacts are provided for making connection between the battery terminals and starter motor and respective leads which are connected to the two sides of the safety switch so that manual starting requires closing of the safety switch, as well as the closing of both bridging contacts. The bridging contacts are preferably contacts secured inside an insulation housing which prevents access to the battery and coil terminals for bridging from the outside. Pressure on the housing pushes the bridging contacts into contact with their respective relay terminals.

2 Claims, 3 Drawing Figures

STARTER ARRANGEMENT FOR INTERNAL COMBUSTION ENGINE

BACKGROUND OF THE INVENTION

This invention relates to a starter arrangement for an internal combustion engine.

It is important to prevent inadvertent movement of vehicles when operating the starter. This is especially important for a diesel engine which can be started without completing any ignition circuit, thus creating the serious risk of a runaway vehicle. Energizing circuits may be provided with switches to preclude completion of the circuit when the engine is coupled to a load.

It is also necessary to provide some means for starting the engine during construction, testing or even maintenance. For example, it may be necessary to start the engine of a partially built vehicle which has not yet got its instrument panel. In many known devices, the battery and coil or motor terminals of the relay are accessible and close to each other so that it is a simple matter for the mechanic to bridge them and by-pass the relay. It is also well known to provide the relay with a manual button for closing the contacts. However, these arrangements completely vitiate the function of the safety switch since the engine, especially a diesel engine, can be started with the safety switch open.

SUMMARY OF THE INVENTION

An object of this invention is to overcome the problem thus posed by making manual completion of the circuit for the starter motor also dependent upon the closure of the safety switch.

This, and other objects, are achieved by the present invention which provides a starter arrangement for an internal combustion engine. The starter arrangement has a starter relay which includes a battery terminal, a starter motor terminal connected to the starter motor and a coil for making the relay contacts, with a coil terminal and an energizing circuit which includes a safety switch, as well as an ignition switch and starter switch. Two manually-operable bridging contacts are provided for making connection between the battery terminals and starter motor and respective leads which are connected to the two sides of the safety switch so that manual starting requires closing of the safety switch, as well as the closing of both bridging contacts. The bridging contacts are preferably contacts secured inside an insulating housing which prevents access to the battery and coil terminals for bridging from the outside. Pressure on the housing pushes the bridging contacts into contact with their respective relay terminals. The safety switch precludes starting the engine when it is coupled to a load and may take various forms. For example, in the case of a vehicle engine, the safety switch can be mechanically or hydraulically coupled to the gear selector mechanism, the clutch or hydraulic coupling in order to prevent starting of the engine when it is coupled to the wheels. Reliance may be placed upon the provision of the bridging contacts to dissuade the mechanic from other means of bridging the terminals, but, for increased safety, the invention preferably employs an insulated housing which prevents access to the battery and coil terminals, but which allows the bridging contacts to contact the battery and coil terminals.

DETAILED DESCRIPTION

Figure 1:
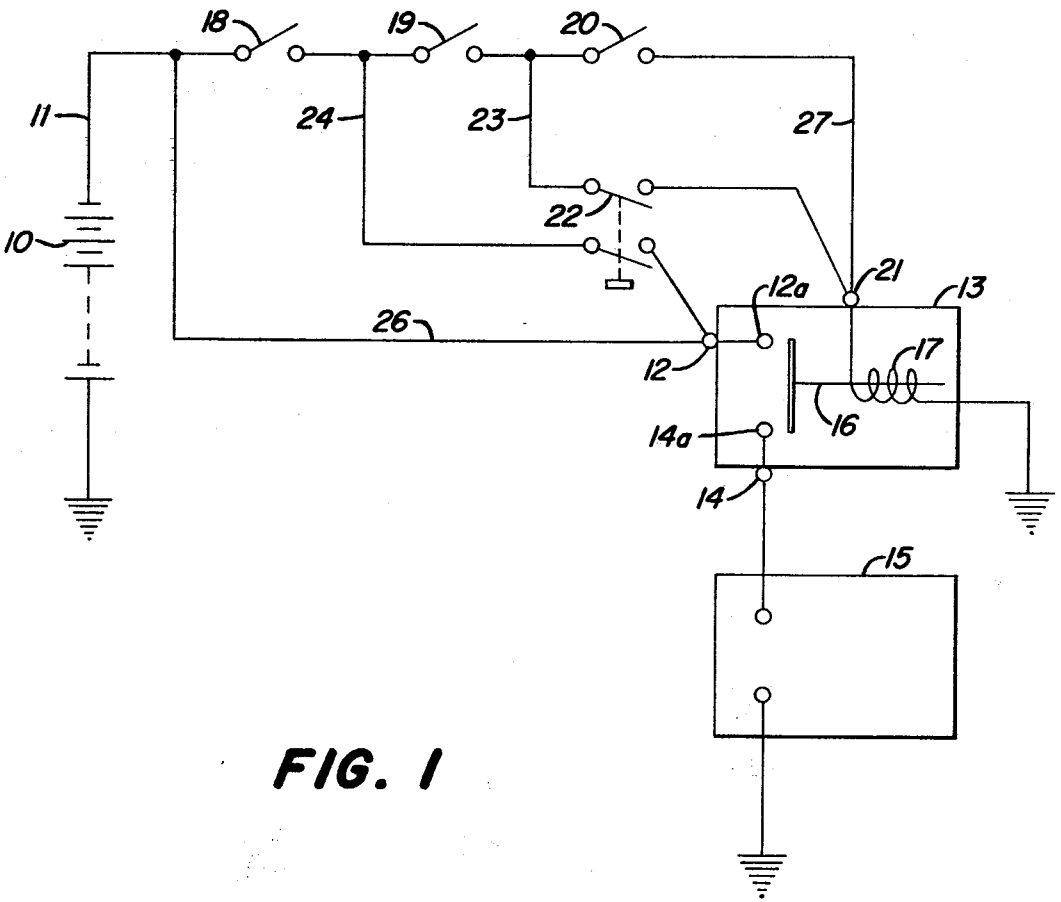
FIG. 1 shows the circuit diagram of an embodiment of the invention.

Referring to FIG. 1, the positive terminal 11 of the battery 10 of a vehicle is connected to the external battery terminal 12 of a starter relay 13. The terminal 12 is connected to a corresponding contact 12A inside the relay. Another contact 14A inside the relay is connected via an external motor terminal 14 to the starter motor 15.

The relay has an armature 16 and a solenoid coil 17. When the coil is energized, the armature makes the contact 12A to the contact 14A to energize the motor 15. The energizing circuit for the coil 17 from the positive terminal 11 to an external coil terminal 21 comprises contacts 18 of an ignition switch, a safety switch 19 and a starter switch 20, which are connected in series so that all have to be closed to pull in the relay.

Bridging contacts for connecting the terminals 12 and 21 are represented schematically as manually closeable switches 22 making connection to cables 23 and 24 which lead to opposite sides of the safety switch 19. As shown in FIG. 1, the switches 22 are in parallel with the ignition switch 18 and the starter switch 20, and switches 22 are in series with safety switch 19. It can be seen that a manually-operable circuit for energizing the solenoid coil 17 is thereby provided but which still requires the switch 19 to be closed. The circuit is from the battery terminal 11 through the terminal 12 on the relay, one switch 22, cable 24, switch 19, cable 22, the other switch 22 and terminal 21 to the solenoid coil.

Figure 3:
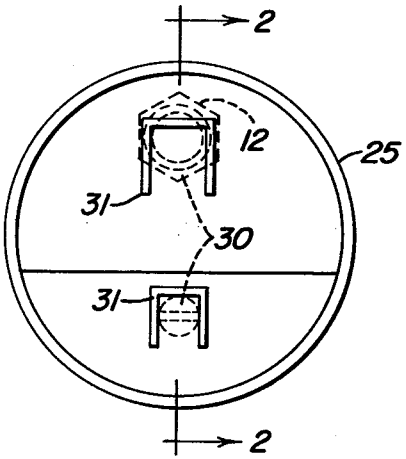
FIG. 3 is an end view of the relay.
Figure 2:
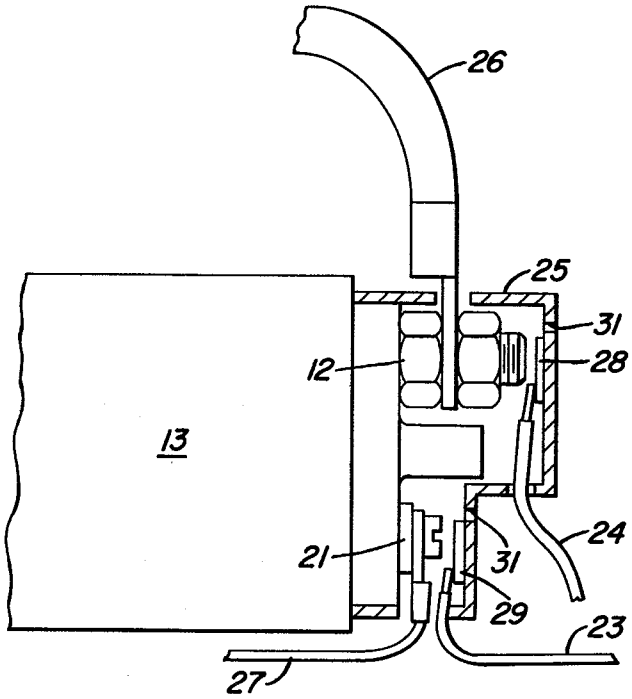
FIG. 2 is a schematic side view of one constructional form of part of the relay, partly in section on the line 2—3 of FIG. 3.

FIGS. 2 and 3 illustrate a preferred relay contruction. The external terminals 12 and 21 are enclosed within an insulating housing 25 which prevents the terminals being bridged from outside. The main battery lead 26 and solenoid lead 27 are attached to the terminals 12 and 21, respectively. On the inside end wall of the housing 25, there are fixed two bridging contacts 28 and 29 corresponding to the switches 22 of FIG. 1. The leads 24 and 23 are attached to the contacts 28 and 29, respectively, which are opposed to terminals 12 and 21 so that by pressing in on the end of the housing 25, they can be pressed simultaneously into contact with the terminals 12 and 14. To facilitate this, the contacts 28 and 29 can be on tongues 30 formed in the end wall by U-slots 31.

Many constructional variants are possible. The contacts 28 and 29 could be on an insulating carrier with a push button protruding through the housing 25. The contacts could be inside individual, deformable insulating caps of the terminals 12, 21.

It may be desired to allow the manual starter facility only during manufacture. This is easily achieved by removing the leads 23, 24 on completion of manufacture, before delivery. For this purpose, the leads are preferably attached by connectors such that the leads can simply be pulled out of the housing 25, and also away from similar connectors at the two sides of the switch 19. Once this has been done, it is not possible to start the motor other than by way of all three switches 18, 19 and 20 because the housing 25 prevents access to the terminals 12 and 21 so that they can no longer be bridged.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. A starter system for a battery powered starter motor coupled to an internal combustion engine, the starter system comprising:

a starter relay having a motor terminal connected to the starter motor, a battery terminal connected to the battery, a coil terminal and means for connecting the battery terminal to the motor terminal in response to energization of the coil terminal;

an energizing circuit for energizing and de-energizing the coil terminal, the energizing circuit comprising an ignition switch, a safety switch and a starter switch connected in series between the coil terminal and the battery; and a deformable insulating housing for preventing access to at least the battery terminal and the coil terminals; and first and second manually operable bridging switches, the first bridging switch being connected in parallel with the ignition switch and the second bridging switch being connected in parallel with the starter switch, the bridging switches including first and second conductive contact mounted on an inner surface of the housing for engagement with the battery and coil terminals, respectively, upon deformation of the housing.

2. The starter system of claim 1, wherein: the first bridging contact is connected to one side of the safety switch and the second bridging contact is connected to another side of the safety switch, the bridging contacts being electrically isolated from each other to prevent energization of the coil terminal when the safety switch is open.

* * * * *

UNITED STATES PATENT AND TRADEMARK OFFICE

CERTIFICATE OF CORRECTION

PATENT NO. : 4,436,065

DATED : 13 March 1984

INVENTOR(S) : Gerhard Gradmann

It is certified that error appears in the above-identified patent and that said Letters Patent is hereby corrected as shown below:

Column 4, line 11, delete "contact" and insert -- contacts --.

Signed and Sealed this

*First* Day of *January 1985*

[SEAL]

*Attest:*

GERALD J. MOSSINGHOFF

*Attesting Officer*

*Commissioner of Patents and Trademarks*